US012188330B2

(12) United States Patent
Alharith

(10) Patent No.: US 12,188,330 B2
(45) **Date of Patent: *Jan. 7, 2025**

(54) TREATMENT OF ORGANIC DEPOSITS USING MICROWAVE HEATING

(71) Applicant: SAUDI ARABIAN OIL COMPANY, Dhahran (SA)

(72) Inventor: Abdullah M. Alharith, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 160 days.

This patent is subject to a terminal disclaimer.

(21) Appl. No.: 17/818,542

(22) Filed: Aug. 9, 2022

(65) Prior Publication Data

US 2024/0052737 A1 Feb. 15, 2024

(51) Int. Cl.
*E21B 36/04* (2006.01)
*E21B 43/24* (2006.01)

(52) U.S. Cl.
CPC ..... *E21B 36/04* (2013.01); *E21B 43/2401* (2013.01)

(58) Field of Classification Search
CPC ..... E21B 43/2401; E21B 43/2403
See application file for complete search history.

(56) References Cited

U.S. PATENT DOCUMENTS 5,247,994 A * 9/1993 Nenniger ..... E21B 36/04 219/415
6,189,611 B1 2/2001 Kasevich
8,720,550 B2 5/2014 Banerjee et al.
10,053,959 B2 8/2018 Ayub et al.
11,187,066 B2 11/2021 Aljindan et al.
2011/0079389 A1* 4/2011 MacKay ..... E21B 33/138 166/281
2012/0012319 A1 1/2012 Dennis
2014/0014327 A1 1/2014 Badri et al.
(Continued)

FOREIGN PATENT DOCUMENTS

CA 2777956 A1 12/2012
CN 103225497 B 7/2015

OTHER PUBLICATIONS

Non-Final Office Action issued in related U.S. Appl. No. 17/818,536 dated Jul. 17, 2023 (16 pages).
(Continued)

*Primary Examiner* — Brad Harcourt
(74) *Attorney, Agent, or Firm* — Osha Bergman Watanabe & Burton LLP

(57) ABSTRACT

A downhole tool includes a body including a microwave generator, a susceptor shell connected to the body, the susceptor shell having wall made of susceptor material and a cavity formed between the wall and the body, and a thermometer connected to the body. A system includes a well extending from a surface, a microwave heating tool positioned in the well, a thermometer, and an electrical cable extending from a power source at the surface to the microwave heating tool. A method of treating organic deposits in a well includes lowering a microwave heating tool into the well to a treatment zone including organic deposits, providing power to the microwave heating tool via an electrical cable, increasing a temperature of the treatment zone to an elevated temperature using heat generated from the microwave heating tool, and melting the organic deposits in the treatment zone.

17 Claims, 3 Drawing Sheets

(56) References Cited

U.S. PATENT DOCUMENTS

| | | | | |
|---|---|---|---|---|
| 2014/0352973 | A1 | 12/2014 | Dwars | |
| 2015/0233211 | A1* | 8/2015 | Bujold | E21B 36/00 166/60 |
| 2016/0053596 | A1* | 2/2016 | Rey | E21B 43/26 166/302 |
| 2017/0298718 | A1* | 10/2017 | Mills | E21B 23/10 |
| 2019/0048685 | A1* | 2/2019 | Batarseh | E21B 36/005 |
| 2020/0290892 | A1 | 9/2020 | Al-Mulhem | |

OTHER PUBLICATIONS

Amani, Mahmoud and Nguyen T. Nguyen, "An Overview of Methods to Mitigate Condensate Banking in Retrograde Gas Reservoirs", Advances in Petroleum Exploration and Development, CSCanada, vol. 9, No. 2, 2015, pp. 1-6 (6 pages).

Allan, Shawn, et al., "Microwave Heating Technologies", Heat Treating Process, Nadcap, May/Jun. 2008, pp. 39-42 (4 pages).

Bjorndalen, N. and M.R. Islam, "The effect of microwave and ultrasonic irradiation of crude oil during production with a horizontal well", Journal of Petroleum Science and Engineering, ScienceDirect, Elsevier B.V., vol. 43, 2004, pp. 139-150 (12 pages).

Karami, Saeed, et al., "Condensate blockage removal using microwave and ultrasonic waves: Discussion on rock mechanical and electrical properties", Journal of Petroleum Science and Engineering, Journal Pre-Proof, Elsevier B.V., 2020, doi: https://doi.org/10.1016/j.petrol.2020.107309 (39 pages).

Vlaicu, Mihaela, et al., "Downhole Heating Technology—New Solution for Paraffinic Wells", SPE-206128-MS, Society of Petroleum Engineers, Sep. 2021, pp. 1-24 (24 pages).

Singh, K., et al., "Thermo Chemical In-Situ Heat Generation Technique to Remove Organic Solid Deposition: Effective Tool for Production Enhancement and Flow Assurance", OTC 23933, Offshore Technology Conference, May 2013, pp. 1-14 (14 pages).

* cited by examiner

TREATMENT OF ORGANIC DEPOSITS USING MICROWAVE HEATING

BACKGROUND

Organic deposits are commonly found in the tubing of a well and are caused when liquid hydrocarbons precipitate due to a decrease in temperature and/or pressure. Downhole, liquid hydrocarbons may come into contact with a variety of compounds including water, rock, drilling material, and production chemicals, all of which may contribute to the formation of organic deposits in a well. The accumulation of organic deposits can form a barrier that disrupts the production of oil from the well. Therefore, numerous techniques have been developed to treat wells with accumulated organic deposits.

Generally, organic deposits are reduced by dissolution in chemical solvents or high temperature oil and melting with a mechanical heater. These techniques typically incur high costs, environmental damage, and lost time, as they often require the well to be temporarily shut down.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole tool that includes a body including a microwave generator, a susceptor shell connected to the body, the susceptor shell having wall made of susceptor material and a cavity formed between the wall and the body, and a thermometer connected to the body.

In another aspect, embodiments disclosed herein relate to a system including a well extending from a surface, a microwave heating tool positioned in the well, a thermometer, and an electrical cable extending from a power source at the surface to the microwave heating tool. The microwave heating tool includes a body including a microwave generator and a susceptor shell connected to the body.

In yet another aspect, embodiments disclosed herein relate to a method of treating organic deposits in a well. The method includes lowering a microwave heating tool into the well to a treatment zone including organic deposits, wherein the microwave heating tool includes a microwave generator, a susceptor material including a cavity, and a thermometer, wherein the microwave generator is attached to the cavity of the susceptor material. The method then includes providing power to the microwave heating tool via an electrical cable, wherein the electrical cable connects the microwave generator to a power source at a surface of the well, generating microwave radiation from the microwave generator that is then absorbed by the susceptor material to generate heat, increasing a temperature of the treatment zone to an elevated temperature using the generated heat, and melting the organic deposits in the treatment zone.

Other aspects and advantages of the claimed subject matter will be apparent from the following description and the appended claims.

BRIEF DESCRIPTION OF DRAWINGS

Wherever possible, identical reference numerals are used in the figures to identify common of the same elements. The figures are not necessarily to scale and certain features and certain views of the figures may be shown exaggerated in scale for purposes of clarification.

DETAILED DESCRIPTION

Embodiments disclosed herein generally relate to systems and methods for heating and treating selected areas of a well, e.g., to treat organic deposits in the well of a hydrocarbon reservoir. Systems in accordance with the present disclosure include a downhole microwave heating tool including a microwave generator, a susceptor material, and a thermometer. Such systems may be used to heat a treatment zone of a well. For example, methods in accordance with one or more embodiments may include lowering the system to a treatment zone in a well of a hydrocarbon reservoir and heating the treatment zone to an elevated temperature. In some embodiments, the microwave heating tool may be lowered to a treatment zone having organic deposits accumulated on the well walls, where the microwave heating tool may heat the treatment zone such that accumulated organic deposits melt. In such manner, the microwave heating tool may be used to reduce or eliminate organic deposits that have accumulated on the wellbore wall.

Figure 1A:
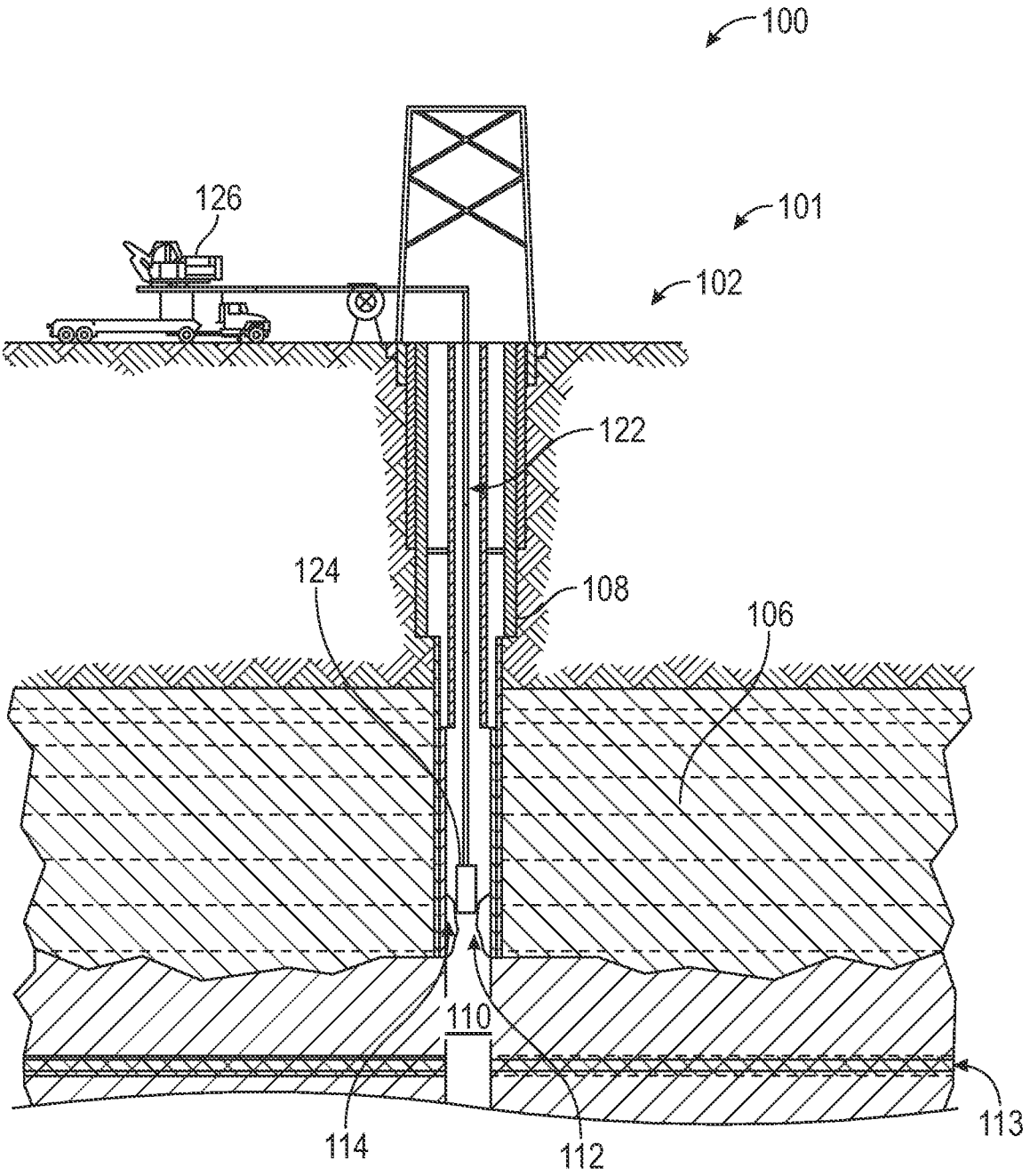
FIG. 1A is schematic diagram of a system in accordance with one or more embodiments of the present disclosure.

A system 100 in accordance with one or more embodiments is shown in, and discussed with reference to, FIG. 1A. System 100 includes well environment 101 having surface 102 and subsurface 106. A well 110 having well wall 108 extends downhole from surface 102 into subsurface 106, and through a hydrocarbon reservoir 113. Hydrocarbon reservoir 113 may be an oil reservoir. A treatment zone 112 may be selected along the length of the well 110, for example, as a region of well 110 located above hydrocarbon reservoir 113. In one or more embodiments, the treatment zone 112 is in the wellbore of the well. In other embodiments, the treatment zone may be in an uncased section of the well. In one or more embodiments, treatment zone 112 contains organic deposits 114 along well wall 108. Organic deposits often accumulate on the walls of production wells because of the decreased pressure and temperature experienced closer to the surface. These organic deposits may have been liquid at reservoir conditions, e.g., elevated pressure and temperature, and upon production from the reservoir and removal from such conditions, turned to solids that are deposited on the well walls, as shown in FIG. 1A. Exemplary organic deposits that may accumulate on a well wall include, but are not limited to, wax, asphaltene, hydrates, and combinations thereof.

While the system 100 shown in FIG. 1A shows one example of a well 110 configuration to be treated, other types of wells may be treated according to embodiments disclosed herein. For example, embodiments of the disclosure may also be used with horizontal or directional wells, wells having production tubing installed, wells having at least a portion of the wellbore wall cased or lined (e.g., as shown in FIG. 1A), uncased wells, and wells that extend to other types of reservoir or wells that do not extend to hydrocarbon reservoirs.

Systems 100 in accordance with one or more embodiments may also include a microwave heating tool 124 positioned inside wellbore 110. The microwave heating tool 124 may be lowered into a well via a wireline or other type of running tool including an electrical cable 122, which may connect the microwave heating tool 124 to surface equipment 126. The surface equipment 126 may have an electrical power source. In one or more embodiments, surface equipment 126 supplies electrical power to microwave heating tool 124 through electrical cable 122. As depicted in FIG. 1A, electrical cable 122 may be provided as wireline to suspend microwave heating tool 124 in a position in the wellbore 110. The position may be at or near treatment zone 112. Additionally, the microwave heating tool 124 may be lowered into, raised out of, and moved to different positions within the well using the wireline. Advantageously, by using the microwave heating tool 124 according to embodiments disclosed herein, which may by positioned in a well via a wireline or other type of running line, the microwave heating tool 124 may be easily repositioned within the well (e.g., to treat multiple treatment zones in the well) and/or reused in different wells.

Figure 1B:
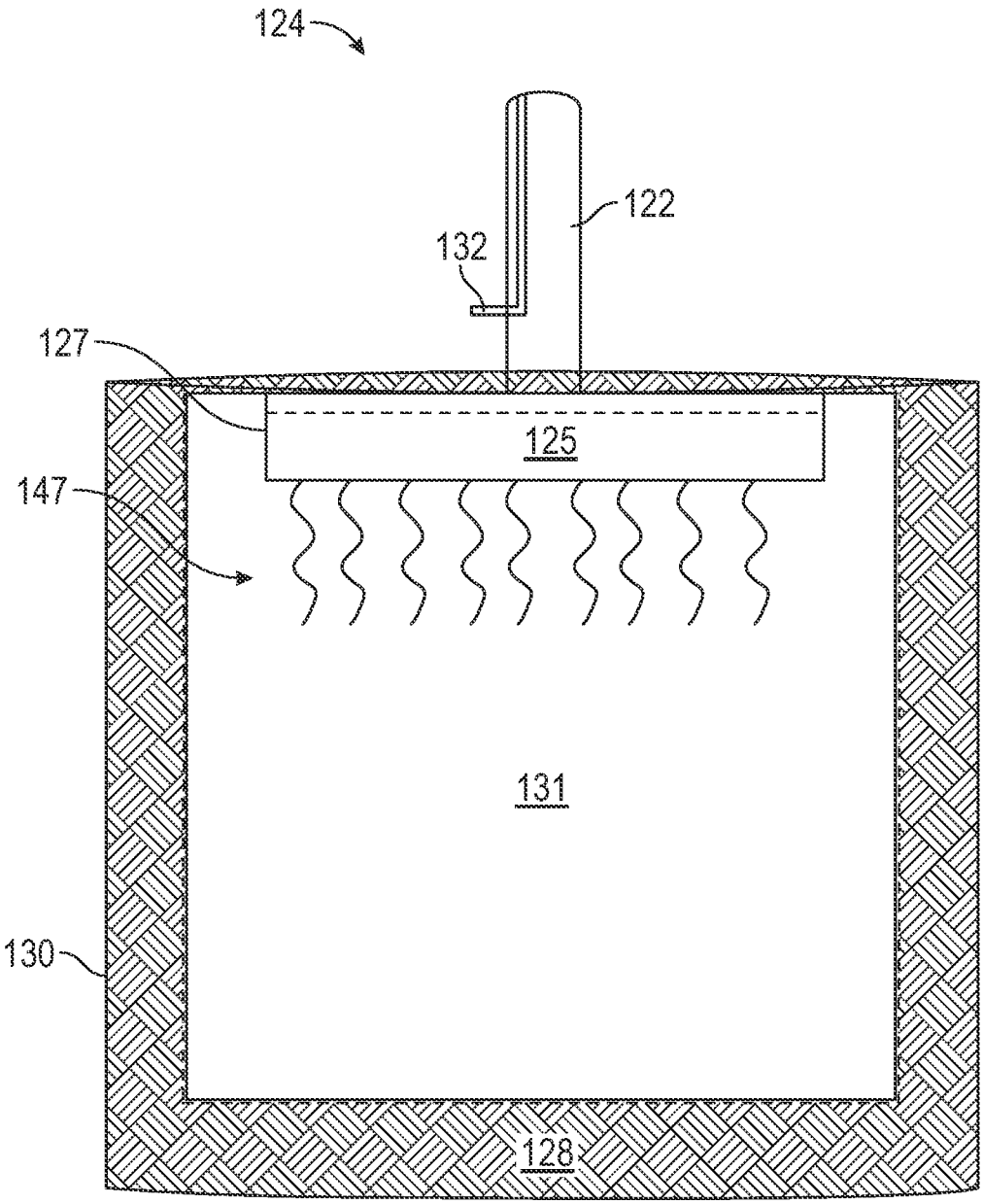
FIG. 1B is schematic diagram of a downhole tool in accordance with one or more embodiments of the present disclosure.

A schematic diagram of microwave heating tool 124 is shown in FIG. 1B. Microwave heating tool 124 has a body 125 that includes microwave generator 127. Microwave generator 127 may be any suitable microwave generator known in the art.

As depicted in FIG. 1B, the body 125 of microwave heating tool 124 is connected to electrical cable 122 on a first side of the body 125. The electrical cable 122 may include, for example, electric line (E-line), e.g., a multiple strand wire armor cable around a single insulated electrical conductor wire, multiple conductor wires in armored or insulated cable, wireline, electrical cable provided in a coiled tubing, or other configuration of electrical cable that is capable of both holding the microwave heating tool 124 in hole and carrying electricity to the microwave generator 127.

A susceptor shell 128 may extend from a second side of the body 125 in a direction opposite the first side of the body 125. Susceptor shell 128 may form wall 130 around the body of the microwave heating tool such that the microwave generator is connected to an opening of cavity 131 of the susceptor shell. The susceptor shell may be any size that fits downhole. The size of the susceptor shell may be related to the amount of heat that is delivered downhole. For example, a large susceptor shell may be used to deliver more heat whereas a small susceptor shell may be used to deliver less heat. Relatively larger susceptor shells may be designed, for example, by designing the susceptor shell to extend farther from the microwave heating tool body (and thus having a relatively larger cavity formed between the microwave heating tool body and the susceptor shell). In such manner, susceptor shells may define cavities of different sizes to provide different sizes of susceptor shells, and thus deliver different amounts of heat. By designing larger susceptor shells to extend a greater axial length away from the microwave heating tool body (as opposed to using a susceptor shell with an increased radial width), the susceptor shell may deliver an increased amount of heat while also being capable of fitting downhole through a well. Alternatively, the susceptor shell may be coated around the microwave generator such that no cavity is formed.

The microwave generator 127 may convert electricity supplied form the electrical cable 122 to microwave radiation 147. The generated microwave radiation 147 may be directed (e.g., through a wave guide) into the cavity 131 formed within the susceptor shell 128. The wall of susceptor shell 128 may be made of a susceptor material. The susceptor material may include any suitable material able to absorb the microwave radiation from microwave generator 127. Suitable susceptor materials may also exhibit rapid heating ability upon exposure to microwave radiation. For example, in one or more embodiments, the susceptor material is activated carbon, silicon carbide, aluminum oxide, or combinations thereof.

The susceptor shell may have a rigid structure. As such, upon lowering downhole, should the microwave heating tool contact the formation, the susceptor shell may be damaged. To mitigate damage, the susceptor shell may have a thickness sufficient to withstand pressure such as natural downhole pressure and pressure from any such contact with the formation.

A susceptor shell may be connected to a body of a microwave heating tool using one or more connection elements to attach an end of the susceptor shell to the body. For example, as shown in FIG. 1B, an axial end of a susceptor shell 128 may be fitted around and mounted to the microwave heating tool body 125. In some embodiments, a susceptor shell 128 may be connected to the body 125 using, for example, a clamp, bolts, or other connection element.

Figure 2:
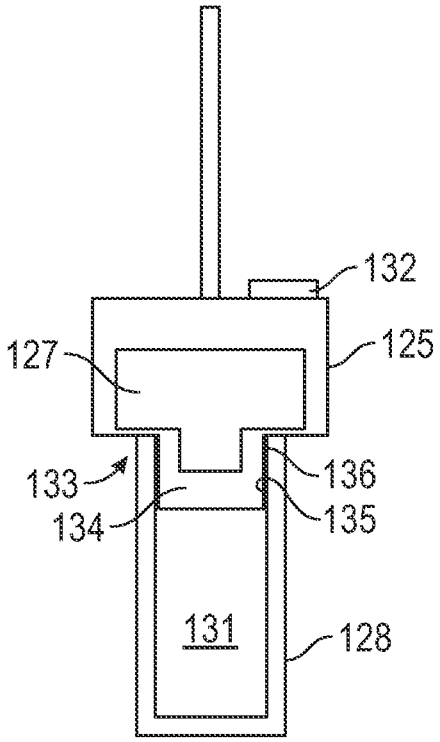
FIG. 2 is a schematic diagram of a downhole tool in accordance with one or more embodiments of the present disclosure.

In another example, as shown in FIG. 2, a susceptor shell 128 may have a threaded portion 135 formed at an axial end 133, where the threaded portion 135 may be threaded to a corresponding threaded portion 136 along the microwave heating tool body 125. In the embodiment shown, the microwave heating tool body 125 may hold a microwave generator 127. The microwave generator 127 may be arranged within the body 125 such that microwave radiation is directed by a wave guide through an extension 134 of the body 125. The threaded connection between the susceptor shell 128 and the body 125 may be provided around the extension 134 of the body, where the susceptor shell extends axially from the extension 134 away from the body 125. In such configuration, when microwave radiation exits the extension 134, the microwave radiation may enter the cavity 131 in the susceptor shell 128 and heat the susceptor shell 128.

A microwave heating tool 124 may also include thermometer 132. Thermometer 132 may be any suitable known temperature measurement device. In some embodiments, the thermometer 132 may be attached along a side of the microwave heating tool body 125 and extend axially from the body in an outer area around the susceptor shell 128. By positioning the thermometer in an outer area around the susceptor shell 128, a more accurate reading of the temperature of the susceptor shell 128 may be collected. In other embodiments, a thermometer may be positioned along different portions of the microwave heating tool body, or disposed on the electrical cable 122, proximate to the microwave heating tool body.

In one or more embodiments, thermometer 132 is used to measure the downhole temperature of treatment zone 112 before treating with microwave heating tool 124. Temperature measurements taken by thermometer 132 may be sent to the surface of the well for processing via the wireline on which the microwave heating tool is deployed. In some embodiments, thermometer 132 is used to monitor the temperature change in the treatment zone of the wellbore upon treatment with microwave heating tool 124. In such embodiments, thermometer 132 may provide real-time temperature data to surface equipment 126 for processing, analysis, or data storage, for example.

In some embodiments, real-time temperature data may be used to determine how much electrical power to supply to microwave heating tool 124. For example, if the temperature of the treatment zone is not hot enough, power may be supplied at a greater wattage or for a longer period of time in order to achieve the desired temperature and melt accumulated organic deposits. On the other hand, if the temperature of the treatment zone is too hot, power to the downhole microwave heating tool may be cut, and the tool may be raised so as not to be damaged at the increased temperature. The microwave heating tool may be used at any downhole temperature. For example, the microwave heating tool may be operable at temperatures ranging from 50 to 150° C.

In heating the downhole environment, the microwave heating tool may heat to a temperature ranging from 50 to 800° C. For example, the microwave heating tool may heat to a temperature ranging from a lower limit of one of 50, 100, 150, 200, 250, 300, and 400° C. to an upper limit of one of 400, 500, 600, 700, and 800° C., where any lower limit may be paired with any mathematically compatible upper limit. However, it may not be necessary to heat much beyond the natural downhole temperature.

Figure 3:
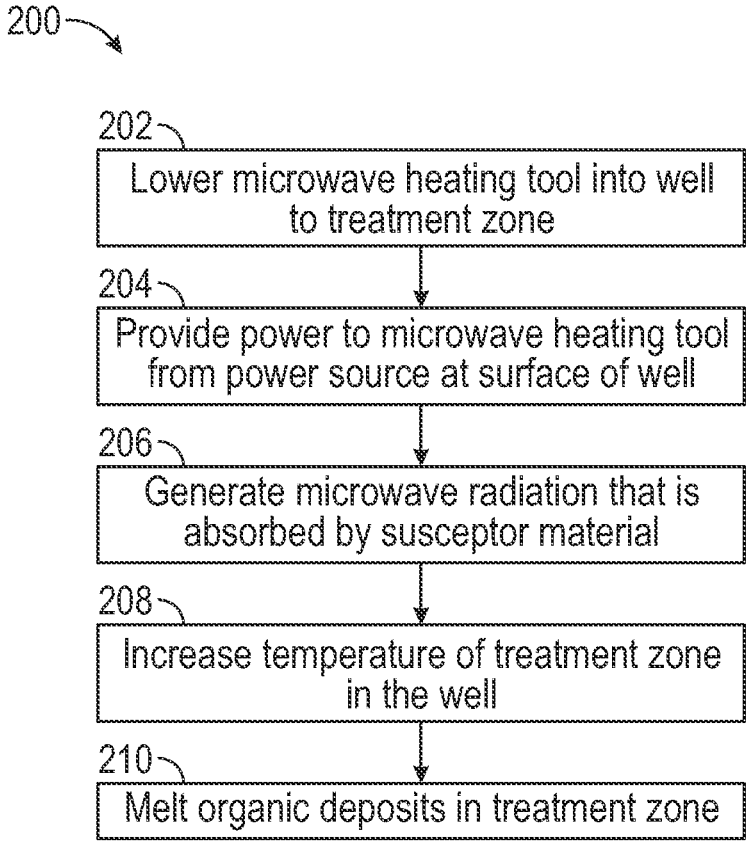
FIG. 3 is a block-flow diagram of a method in accordance with one or more embodiments of the present disclosure.

A method 200 for treating a well using a system in accordance with one or more embodiments is depicted in FIG. 3. The method 200 may be used, for example, to treat a portion of the well containing organic deposits, such as those occurring from production of an oil reservoir. Method 200 initially includes lowering a microwave heating tool according to embodiments of the present disclosure into a well to a treatment zone 202. The treatment zone may contain organic deposits. In one or more embodiments, the microwave heating tool may be lowered to the treatment zone in the wellbore using an electrical cable (e.g., provided as a wireline) connected to a power source at a surface of the wellbore.

In some embodiments, a microwave heating tool may be positioned within a well during production, where production fluids from a surrounding reservoir may flow through the well and around the microwave heating tool.

Once the microwave heating tool is positioned in the wellbore at the treatment zone, method 200 includes providing power to the microwave heating tool from the power source at the surface of the wellbore via the electrical cable 204. The microwave heating tool may heat rapidly. For example, it may take about 10 seconds to 5 minutes for the microwave heating tool to heat the target zone to the desired temperature. In one or more embodiments, the microwave heating tool may heat the treatment zone for an amount of time ranging from a lower limit of one of 10, 20, 30, 40, 50, and 60 seconds to an upper limit of one of 2, 3, 4, and 5 minutes, where any lower limit may be paired with any mathematically compatible upper limit. As such, the amount of power required to heat the microwave heating tool may be minimal.

Upon receiving power, the microwave generator may emit microwave radiation that is then absorbed by the susceptor material 206. As described above, the susceptor material may exhibit rapid heating upon absorption of microwave radiation. Accordingly, in method 200, rapid heating of the susceptor material leads to dissemination of that heat into the wellbore, effectively increasing the temperature of the treatment zone to an elevated temperature 208. In one or more embodiments, the treatment zone of the wellbore may be heated by the susceptor material to an elevated temperature suitable to melt accumulated organic deposits 210. For example, the target zone may be heated to a temperature ranging from 50 to 800° C. Depending on the type of susceptor material and the time and power of heating, the treatment zone may be heated to a temperature ranging from a lower limit of one of 50, 100, 150, 200, 250, 300, and 400° C. to an upper limit of one of 400, 500, 600, 700, and 800° C., where any lower limit may be paired with any mathematically compatible upper limit.

When organic deposits are melted to a liquid phase, the liquid may be removed from the treatment zone and flowed to the surface of the well. Additionally, as organic deposits are melted and removed from the wellbore wall, hydrocarbons from the surrounding wellbore area may escape through the cleared well and produced (e.g., flowed through production tubing to the surface of the well).

As previously described, a thermometer on the microwave heating tool may be used to monitor the change in temperature of the treatment zone. In one or more embodiments, after heating the treatment zone to a temperature sufficient to melt the organic deposits, the microwave heating tool may be removed from the wellbore.

In one or more embodiments, as an effect of the increased temperature in the target zone of the wellbore, the pressure in the treatment zone may increase as well. The pressure increase may be directly related to the temperature increase of the treatment zone. In such embodiments, the increased pressure and temperature of the target zone may decrease the viscosity of downhole fluids such as heavy oil, thus increasing the production of hydrocarbons from the reservoir.

Embodiments of the present disclosure may provide at least one of the following advantages. By using downhole microwave heating tools according to embodiments of the present disclosure (including a microwave generator and a susceptor material provided in a single tool) the microwave heating tool may be moved through a well to a selected are to be treated. Additionally, the microwave heating tool may be used at multiple different depths in a single wellbore and in various different wellbores. Further, by using microwave energy to heat a susceptor element, which heats a surrounding treatment area, a relatively low amount of energy may be used to eat the selected area of the well being treated. Accordingly, systems and methods described herein may provide an inexpensive, environmentally friendly, simple method for treating organic deposits in a well. Additionally, methods including the downhole microwave heating tool may provide increased hydrocarbon production, due to the increased temperature and pressure provided downhole by the microwave heating tool.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A downhole tool comprising:

a body comprising a microwave generator;

an electrical cable connected to a first side of the body;

a susceptor shell connected to the body, the susceptor shell comprising:

a wall made of susceptor material;

a cavity formed between the wall and the body; and an opening to the cavity formed at an axial end of the susceptor shell, wherein the susceptor shell extends from a second side of the body in a direction opposite the first side, and wherein a portion of the wall extends around the body such that the body is connected to the opening to the cavity; and a thermometer positioned outside of the susceptor shell.

2. The downhole tool of claim 1, wherein the electrical cable extends to a power source located at the surface of a wellbore.

3. The downhole tool of claim 1, wherein the susceptor material is selected from the group consisting of activated carbon, silicon carbide, aluminum oxide, and combinations thereof.

4. A system comprising:

a well extending from a surface;

organic deposits arranged on a wall of the well;

a microwave heating tool positioned in the well, the microwave heating tool comprising:

a body comprising a microwave generator; and a susceptor shell connected to a first axial end of the body, a thermometer connected to an outer side of the body; and an electrical cable extending from a power source at the surface to the microwave heating tool, wherein the electrical cable is connected to a second axial end of the body, opposite the first axial end of the body.

5. The system of claim 4, wherein the microwave heating tool is positioned in a portion of the well extending through a hydrocarbon reservoir and where the organic deposits are arranged.

6. The system of claim 4, wherein the electrical cable suspends the microwave heating tool in the position in the well.

7. A method of treating organic deposits in a well, comprising:

lowering a microwave heating tool into the well to a treatment zone comprising organic deposits, wherein the microwave heating tool comprises:

a body comprising a microwave generator; and a susceptor shell connected to the body, the susceptor shell comprising:

a wall made of a susceptor material;

a cavity formed between the wall and the body; and an opening to the cavity formed at an axial end of the susceptor shell, wherein the susceptor shell extends from a first side of the body, and wherein a portion of the wall extends around the body such that the body is connected to the opening to the cavity; and a thermometer positioned outside of the susceptor shell, providing power to the microwave heating tool via an electrical cable, wherein the electrical cable connects the microwave generator to a power source at a surface of the well;

generating microwave radiation from the microwave generator that is then absorbed by the susceptor material to generate heat;

increasing a temperature of the treatment zone to an elevated temperature using the generated heat; and melting the organic deposits in the treatment zone.

8. The method of claim 7, further comprising increasing a pressure in the treatment zone to an elevated pressure using the increase in temperature of the treatment zone.

9. The method of claim 8, wherein the elevated temperature and the elevated pressure of the treatment zone increases a production of the well.

10. The method of claim 7, wherein the susceptor material is selected from the group consisting of activated carbon, silicon carbide, aluminum oxide, and combinations thereof.

11. The method of claim 7, wherein the thermometer is used to monitor the temperature of the treatment zone during treatment.

12. The method of claim 7, further comprising:

after the temperature of the treatment zone increases to an elevated temperature, removing the microwave heating tool from the treatment zone.

13. The method of claim 7, wherein the treatment zone is in a portion of the well extending through an oil reservoir.

14. The method of claim 7, wherein the microwave heating tool is lowered into the well using the electrical cable.

15. The method of claim 7, wherein the well is in production during the use of the microwave heating tool.

16. The method of claim 7, further comprising repositioning the tool to an additional treatment zone to melt organic deposits in the additional treatment zone.

17. The downhole tool of claim 1, wherein the thermometer is connected to the electrical cable.

* * * * *